US006214175B1

(12) United States Patent
Heinemann et al.

(10) Patent No.: US 6,214,175 B1
(45) **Date of Patent: *Apr. 10, 2001**

(54) METHOD FOR RECOVERING GAS FROM HYDRATES

(75) Inventors: Robert F. Heinemann; David Da-Teh Huang; Jinping Long, all of Plano, TX (US); Roland B. Saeger, Runnemede, NJ (US)

(73) Assignee: Mobil Oil Corporation, Fairfax, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/774,980

(22) Filed: Dec. 26, 1996

(51) Int. Cl.[7] ..... C07C 1/00; B01D 5/00
(52) U.S. Cl. ..... 204/157.15; 204/157.3
(58) Field of Search ..... 204/157.15, 157.3

(56) References Cited

U.S. PATENT DOCUMENTS 5,450,899 * 9/1995 Belonenko et al. ..... 166/248
5,536,893 7/1996 Gudmundsson ..... 585/15
5,625,178 * 4/1997 Rojey ..... 204/157.15
5,919,493 * 7/1999 Sheppard et al. ..... 425/174.2

FOREIGN PATENT DOCUMENTS

2294885 * 5/1996 (GB) .
28 219 * 5/1982 (HU) .
186 511 5/1987 (HU) .
442287 * 11/1974 (SU) .
451888 * 3/1975 (SU) .
1707190 * 1/1992 (SU) .

* cited by examiner

*Primary Examiner*—Kathryn Gorgos
*Assistant Examiner*—Edna Wong
(74) *Attorney, Agent, or Firm*—Gary P. Katz

(57) ABSTRACT

The present invention provides a process for recovering gas from a clathrate hydrate comprising the steps of:

(a) providing a clathrate hydrate within an occupying zone;

(b) positioning a source of electromagnetic radiation within said clathrate hydrate occupying zone; and (c) recovering gas from the clathrate hydrate by applying electromagnetic radiation from the electromagnetic radiation source of step (b) to the clathrate hydrate at a frequency within the range of from direct current to visible light at energy density sufficient to dissociate the clathrate hydrate to evolve its constituent gas.

13 Claims, 3 Drawing Sheets

METHOD FOR RECOVERING GAS FROM HYDRATES

FIELD OF THE INVENTION

This invention relates to a method of dissociating gas hydrates, specifically natural gas and other hydrate-forming gases, into their constituent chemical species, namely the hydrate-forming gas and water, and apparatus therefor.

BACKGROUND OF THE INVENTION

Gas hydrate is a special type of inclusion compound which forms when light hydrocarbon ($C_1$—$C_4$) constituents and other light gases ($CO_2$, $H_2S$, $N_2$ etc) physically react with water at elevated pressures and low temperatures. Natural gas hydrates are solid materials and they do not flow readily in concentrated slurries or solid forms. They have been considered as an industrial nuisance for almost sixty years due to its troublesome properties of flow channel blockage in the oil/gas production and transmission systems. In order to reduce the cost of gas production and transmission, the nuisance aspects of gas hydrates has motivated years of hydrate inhibition research supported by oil/gas industry. (Handbook of Natural Gas, D. Katz etc., pp. 189–221, McGraw-Hill, N.Y., 1959; Clathrate Hydrates of Natural Gases, E. D. Sloan, Jr. Marcel Dekker, Inc. 1991). The naturally occurring natural gas hydrates are also an interest as an alternative energy resource for the industry. (International Conferences on Natural Gas Hydrates, Editors, E. D. Sloan, Jr., J. Happel, M. A. Hnatow, 1994, pp. 225–231-Overview: Gas Hydrates Geology and Geography, R. D. Malone; pp. 232–246-Natural Gas Hydrate Occurrence and Issues, K. A. Kvenvolden).

Since natural gas hydrates contain as much as 180 standard cubic feet of gas per cubic foot of solid natural gas hydrates, several researchers have suggested that hydrates can be used to store and transport natural gases. (B. Miller and E. R. Strong, *Am. Gas. Asso. Mon* 28(2), 63–1946). The high concentration of gas in the hydrates have led researchers to consider intentionally forming these materials for the purpose of storing and transporting natural gases more cost/effectively and safely. U.S. Pat. No. 5,536,893 to Gudmundsson discloses a multi-stage process for producing natural gas hydrates. See also Gudmundsson et al., "Transport of Natural Gas as Frozen Hydrate", ISOPE Conf. Proc., V1, The Hague, NL, June, 1995; "Storing Natural Gas as Frozen Hydrate", SPE Production & Facilities, Feb. 1994.

U.S. Pat. No. 3,514,274 to Cahn et al. teaches a process in which the solid hydrate phase is generated in one or a series of process steps, then conveyed to either storage, or directly to a marine transport vessel requiring conveyance of a concentrated hydrate slurry to storage and marine transport. Pneumatic conveyance of compressed hydrate blocks and cylinders through ducts and pipelines has also been proposed. See Smirnov, L. F., "New Technologies Using Gas Hydrates", Teor. Osn. Khim. Tekhnol., v 23(6), pp. 808–22 (1989), application WO 93/01153, Jan. 21, 1993.

Based upon the published literature (E. D. Sloan, 1991 Clathrate Hydrates of Natural Gases, Marcel Dekker), transporting of a concentrated gas hydrate slurry in a pipe from stirred-tank vessel would appear to be incompatible with reliable operation, or even semi-continuous operation. The blockage of pipes, and fouling of the reactors and mixing units are the critical issues. The searching of chemical/mechanical method to prevent gas hydrate blockage/fouling is still the focus of the current gas hydrate research. (Long, J. "Gas Hydrate Formation Mechanism and Kinetic Inhibition", PhD dissertation, 1994, Colorado School of Mines, Golden, Colorado; E. D. Sloan, "The State-of-the-Art of Hydrates as Related to the Natural Gas Industry", Topical Report GRI 91/0302, June, 1992; Englezos, P., "Clathrate Hydrates", Ind. Eng. Chem. Res., V32, pp. 1251–1274, 1993).

Gas hydrates are special inclusion compounds having a crystalline structure known as a clathrate. Gas molecules are physically entrapped or engaged in expanded lattice of water network comprising hydrogen-bonded water molecules. The structure is stable due to weak van der Waals' between gas and water molecules and hydrogen-bonding between water molecules within the cage structures. Unit crystal of structure I clathrate hydrates comprise two tetrakaidecahedron cavities and six dodecahedron cavities for every 46 water molecules, and the entrapped gases may consist of methane, ethane, carbon dioxide, and hydrogen sulfide. The unit crystal of structure II clathrate hydrates contain 8 large hexakaidecahedron cavities and 16 dodecahedron cavities for every 136 water molecules.

Clathrate hydrates occur naturally in permafrost or deep-ocean environments, thus are considered an important natural resource. Utilizing such a resource requires understanding of gas hydrate formation and dissociation. "Kinetics of Methane Hydrate Decomposition," Kim et al., Chemical Engineering Science, Vol. 42, No. 7, pp.1645–1653 (1987) discusses the kinetics of methane hydrate decomposition, indicating that pressure dependence further depends on the difference in gas fugacities at equilibrium pressure and decomposition pressure. "A Multi-Phase, Multi-Dimensional, Variable Composition Simulation of Gas Production from a Conventional Gas Reservoir in Contact with Hydrates," Burshears et al., Unconventional Gas Technology Symprouis of the Society of Petroleum Engineers, pp. 449–453 (1986), discusses dissociation of hydrates by depressurization without an external heat source. "Hydrate Dissociation in Sediment" Selim et al., 62d Annual Technical Conference and Exhibition of the Society of Petroleum Engineers, pp. 243–258 (1987) relates rate of hydrate dissociation with thermal properties and porosity of the porous media. "Methane Hydrate Gas Production: An Assessment of Conventional Production Technology as Applied to Hydrate Gas Recovery," McGuire, Los Alamos National Laboratory, pp.1–17 (1981) discusses feasibility of hydrate gas production by both thermal stimulation and pressure reduction. "Gas Hydrates Decomposition and Its Modeling", Guo et al., 1992 International Gas Research Conference, pp. 243–252 (1992), attributes difference in chemical potential as the driving force for hydrate dissociation.

U.S. Pat. No. 2,375,559 to Hutchinson et al., entitled "Treatment of Hydrocarbon Gases", discloses a method of forming hydrates by cooling and dispersing the components when combining the components. Similarly, U.S. Pat. No. 2,356,407 to Hutchinson, entitled "System for Forming and Storing Hydrocarbon Hydration", discloses hydrate formation using water and a carrier liquid. U.S. Pat. No. 2,270,016 to Benesh discloses hydrate formation and storage using water and alcohol, thereby forming blocks of hydrate to be stored.

U.S. Pat. No. 3,514,274 to Cahn et al. discloses transportation of natural gas as a hydrate aboard ship. The system uses propane or butane as a carrier. U.S. Pat. No. 3,975,167 to Nierman discloses undersea formation and transportation of natural gas hydrates. U.S. Pat. No. 4,920,752 to Ehrsam relates to both hydrate formation and storage wherein one chamber of a reservoir is charged with hydrate while another chamber is evacuated by decomposition of hydrate into gas and ice.

Hydrates, much like ice, are good insulators. The process taught in the Cahn et al. '274 patent, stores hydrates in a liquid hydrocarbon slurry, thus enabling the liquid hydrocarbon handles to act as a heat transfer agent. But storing and transporting hydrates in their solid form is inherently more efficient because without the liquid component of the slurry, more natural gas (in its hydrate form) can be stored in a given volume.

In recovering gas from gas hydrate, it is also economically advantageous to maintain the above volumetric efficiency, thus favoring minimization of the volume of heat transfer agent needed to supply the hydrate's large heat of dissociation (410 kJ/kg for methane hydrate, approximately 25% higher than ice's heat of melting. Ref: Clathrate Hydrates of Natural Gases, E. D. Sloan, Jr. Marcel Dekker, Inc. 1991).

SUMMARY OF THE INVENTION

Microwave radiation is widely used in both scientific, industrial, and residential applications to efficiently transfer energy to materials containing liquid water. Oil and gas industry examples include: core measurements of permeability and fluid saturation (Ref: Parsons, 1975, Brost et al., 1981, Parmerswar et al., 1992), and oil-water emulsion-breaking in petroleum production (Ref: Oil & Gas Journal, Dec. 2, 1996). Hydrates adsorb excess water (ibid), and adsorbed water molecules can retain liquid-like properties, even at temperatures below 0° C. (Schwann, H. P., Ann. New York Academy of Science v. 125, p. 344, October 1965). The present invention utilizes microwave irradiation of gas hydrates as an efficient route for dissociating hydrates and recovering the resulting gas.

The present invention provides a process for continuously dissociating gas hydrate into its chemical constituents, namely the hydrate-forming gas (e.g. natural gas mixtures), water, plus any other impurities, and comprising the steps of:

(a) providing a clathrate hydrate within an occupying zone;

(b) positioning a source of electromagnetic radiation within said clathrate hydrate occupying zone;

(c) recovering gas from said clathrate hydrate by applying electromagnetic radiation from said electromagnetic radiation source of step (b) to said clathrate hydrate at a frequency within the range of from direct current to visible light at energy density sufficient to dissociate said clathrate hydrate to evolve its constituent gas.

The electromagnetic radiation used in the process of the invention is preferably non-ionizing radiation. The electromagnetic radiation may be suitably directed to a surface of said gas hydrate with a hollow waveguide. Useful frequencies typically include from about 100 Mhz to about 3000 Ghz. The electromagnetic radiation is characterized by wavelength of from about 0.1 mm to about 3 m.

The frequency of the electromagnetic radiation is preferably adjusted to optimize the depth of penetration in the gas hydrate, as dictated by the spatial extent of the hydrate mass to be dissociated. The radiation frequency is also preferably adjusted to optimize the efficiency of energy transfer to the hydrate mass, which is known to be a function of temperature and impurity concentration for several materials ("Microwave Technology", in V. 16 of Kirk-Othmer's Encyclopedia of Chemical Processing, 4th Ed., Marcel Dekker, 1995).

Radiation power level is preferably adjusted to achieve an economically favorable balance between hydrate dissociation rate and efficiency reduction due to concurrent irradiation of free water produced by hydrate dissociation. The liquid water produced from said gas hydrate dissociation may be either disposed, collected and/or held in contact with the solid hydrate during the natural gas recovery steps. In some applications, however, where the water content of the recovered gas stream is necessarily low (e.g. fuel), excessive irradiation of the liquid water may heat the said liquid water sufficiently to increase the water content of the gas stream. In such a scenario, the economic efficiency of the gas recovery process decreases because downstream gas dewatering capital is required.

The process preferably further includes controlling the directing step to irradiate said gas hydrate in preference to said collected liquid water. In the case of irradiating a large hydrate accumulation (e.g. ship or barge hold), the microwave source may be positioned above the hydrate mass and direct the radiation downward. Natural gas hydrates, which are positively buoyant with respect to water, will tend to float on the produced liquid water, reducing the rate of cocurrent irradiation of the said liquid water.

The microwave source may either be stationary or movable. For example, the motion of the microwave source may be controlled by a device capable of sensing the difference in optical reflectance (i.e. albedo) between liquid water and gas hydrate. Alternatively, the microwave source may be designed to translate or rotate in such a manner that a desired region of space is irradiated. Finally, the microwave source may be positioned within the hydrate mass to provide localized irradiation.

The present invention concerns a method for the recovery of water and hydrate forming gases from storage stable gas hydrates. Hydrate-forming gases include: $CO_2$, $H_2S$, natural gas and associated natural gas, just to mention a few. However, in the following, natural gas is in general described as the gaseous component in the recovery process, but it should be evident that a person skilled in the art can apply the principle of the invention to consider hydrate forming gases other than natural gas, and the invention should for that reason not be regarded as limited to use of natural gas only. The present method for recovery of gas from gas hydrates can be adapted to both onshore and offshore operation. The present method may be used in conjunction with gas-from-hydrate recovery methods that exploit other modes of energy transfer (e.g. conduction, convection, mechanical, acoustic, etc.). The present method may be used in the presence of solid, liquid, or gaseous materials co-occupying the gas hydrate containing zone; these said materials may or may not act as agents in the other said gas recovery methods noted above.

FEEDSTOCKS FOR PRODUCING HYDRATES

The present invention recovers gas from hydrates. As noted above, hydrates can be produced commercially using suitable hydrate-forming gases together with an appropriate source of water. Examples of useful sources of water include fresh water from a lake or river as well as salt water (e.g. sea water from the ocean) and any water contaminated by particulates or other materials, such as formation water from oil production. The hydrate-forming gas feedstock may comprise pure hydrocarbon gases ($C_1$—$C_4$), natural gas mixtures, and other hydrate forming gases such as oxygen, nitrogen, carbon dioxide and hydrogen sulfide and their respective mixtures. The gas may be contaminated by other impurities, such as particulate and other non-hydrate forming materials or compounds.

DESCRIPTION OF EMBODIMENTS

The process of this invention recovers gas from a gas hydrate and requires no addition of liquid hydrocarbon for the purpose of heat or mass transfer. In preferred embodiments, the gas hydrate contains less than about 10 wt. % of liquid hydrocarbon, more preferably less than about 1 wt. % liquid hydrocarbon. In particularly preferred embodiments, the gas hydrate is a finely divided solid which is substantially dry.

Three particularly preferred embodiments of the current invention include processes for: (a) recovering gas from storage zone containing gas hydrates, e.g. the hold of a ship or barge, or any other stationery or movable storage zone; (b) recovering gas from a hydrate accumulation inside a gas-transporting pipeline; and (c) recovering gas from a hydrate-bearing rock formation in the vicinity of an oil and/or gas production wellbore.

FIRST EMBODIMENT

Recovery of gas from a storage zone containing gas hydrates

| Typical Process Conditions | Temperature, ° C. Useful | Pre-ferred | More Pre-ferred | Pressure, kPa Useful | Pre-ferred | More Preferred |
|---|---|---|---|---|---|---|
| Natural Gas Recovery from Hydrates | −40 to +40° C. | −30 to +25° C. | −20 to +10° C. | 100 to 500 | 100 to 300 | 102.5 to 200 |

Desirable recovery process temperatures are set by balance between desired gas recovery rate, initial temperature of hydrate mass in zone, and temperature of high-temperature heat sink (ambient). Recovery process temperatures are set by balance between desired gas recovery rate, and materials limitations of storage zone. It is also desirable to keep the zone pressure below that of hydrate equilibrium pressure at a given temperature in order to prevent spontaneous reformation of gas and water into hydrates.

Figure 1:
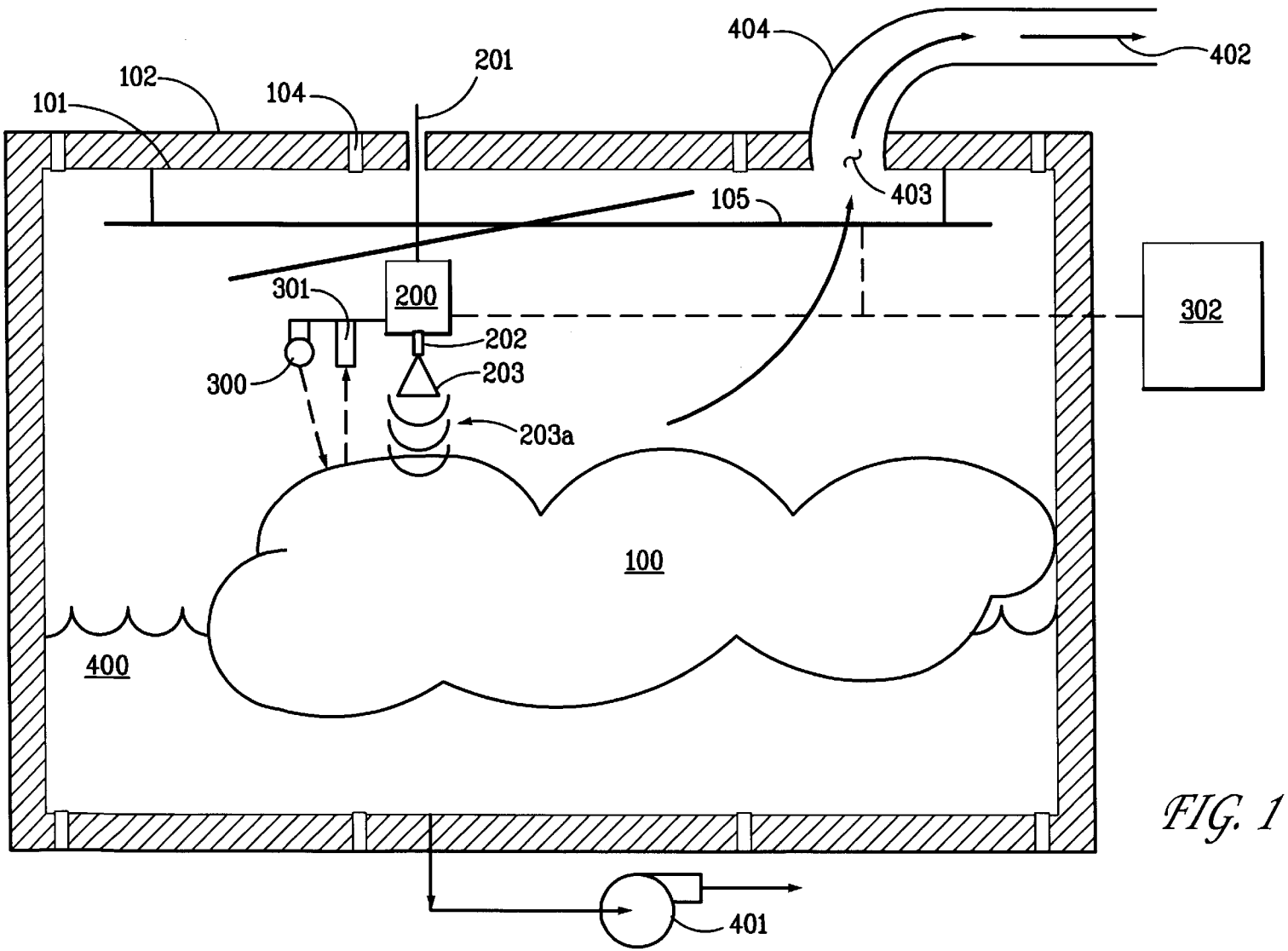
FIG. 1 is a simplified schematic diagram showing major processing steps in one embodiment of the invention, namely gas recovery from hydrates in a storage zone (e.g. hold of a ship or barge).

Now referring to FIG. 1, a hydrate mass 100 occupies the interior of a storage tank's inner wall 101. The latter is separated from the outer wall 102 by a layer of insulation 103. Strengthening members 104 connecting the inner wall 101 to the outer wall 102 impart mechanical strength to the overall tank. Attached to inner top surface of the tank is an x-y positioner 105. Furthermore, this x-y positioner can be raised or lowered vertically, i.e. the z-direction. Attached to the x-y positioner 105 are one or more microwave generators 200 (e.g. Klystron) that receive a DC electrical signal from cables 201 that penetrate the upper surface of the storage tank walls 101, 102. Microwaves 203*a* are passed through a hollow wave guide 202, then targeted at the hydrate mass 100 by way of a horn-type antenna 203. The cables 201 are connected to a D.C. power supply (not shown).

Attached to the horn-type antenna is a visible light source 300, and an optical sensor 301. The light source 300 directs visible light onto the hydrate surface, a fraction of which is reflected back to the sensor 301. Digital or analog signals from the sensor 301 are processed by a computer 302 in order to measure the hydrate and/or water content of the zone that is in the microwave antenna's line-of-sight. The computer 302 then transmits digital or analog signals to the x-y positioner 105, and the microwave generator 200, thus concentrating microwave energy on the hydrate mass, rather than pools or zones of liquid water 400 produced by hydrate dissociation.

Liquid water 400 produced during the gas recovery process may be left in contact with the hydrate mass 100. Because liquid water is denser than natural gas hydrates (Ref: E. D. Sloan "Clathrate Hydrates of Natural Gases", Marcel Dekker, 1991), it will tend to occupy the bottom of the tank, providing flotation to the remaining hydrate. Alternatively, some or all of the liquid water 400 may be withdrawn from the tank by a pump 401. The portion of the water withdrawn from the storage tank may either be stored elsewhere, or treated (if necessary) and disposed to the ambient without environmental risk.

Gas 402, produced during the gas recovery process accumulate at the top of the storage tank. This gas is transparent to microwaves and exits the top storage tank through vents 403 connected to a pipe manifold 404. The pipe manifold 404 directs recovered gas to downstream dewatering and recompression equipment (not shown).

SECOND EMBODIMENT

Recovery of gas from a hydrate accumulation within a pipeline

This embodiment is distinct from the first embodiment described above in that the hydrate-containing zone is a pipeline used to transport natural gas with or without other gaseous components such as $CO_2$ and $H_2S$, with or without fluids such as natural gas liquids, crude or refined petroleum, or water.

| Typical Process Conditions | Temperature, ° C. Useful | Pre-ferred | More Pre-ferred | Pressure, kPa Useful | Pre-ferred | More Preferred |
|---|---|---|---|---|---|---|
| Natural Gas Recovery from Hydrates | −40 to +40° C. | −30 to +25° C. | −20 to +10° C. | 100 to 70,000 | 100 to 30,000 | 102.5 to 200 |

Gas recovery temperature is set by available temperature in the pipeline. Likewise, recovery pressure is set by available pipeline pressure. Preferably, pressure in the section of the pipeline containing the hydrate accumulation is reduced to a level below the gas hydrate equilibrium pressure to avoid spontaneous formation of hydrate. Otherwise, the gas recovery process must be operated intermittently or continuously to prevent hydrate re-accumulation.

Figure 2:
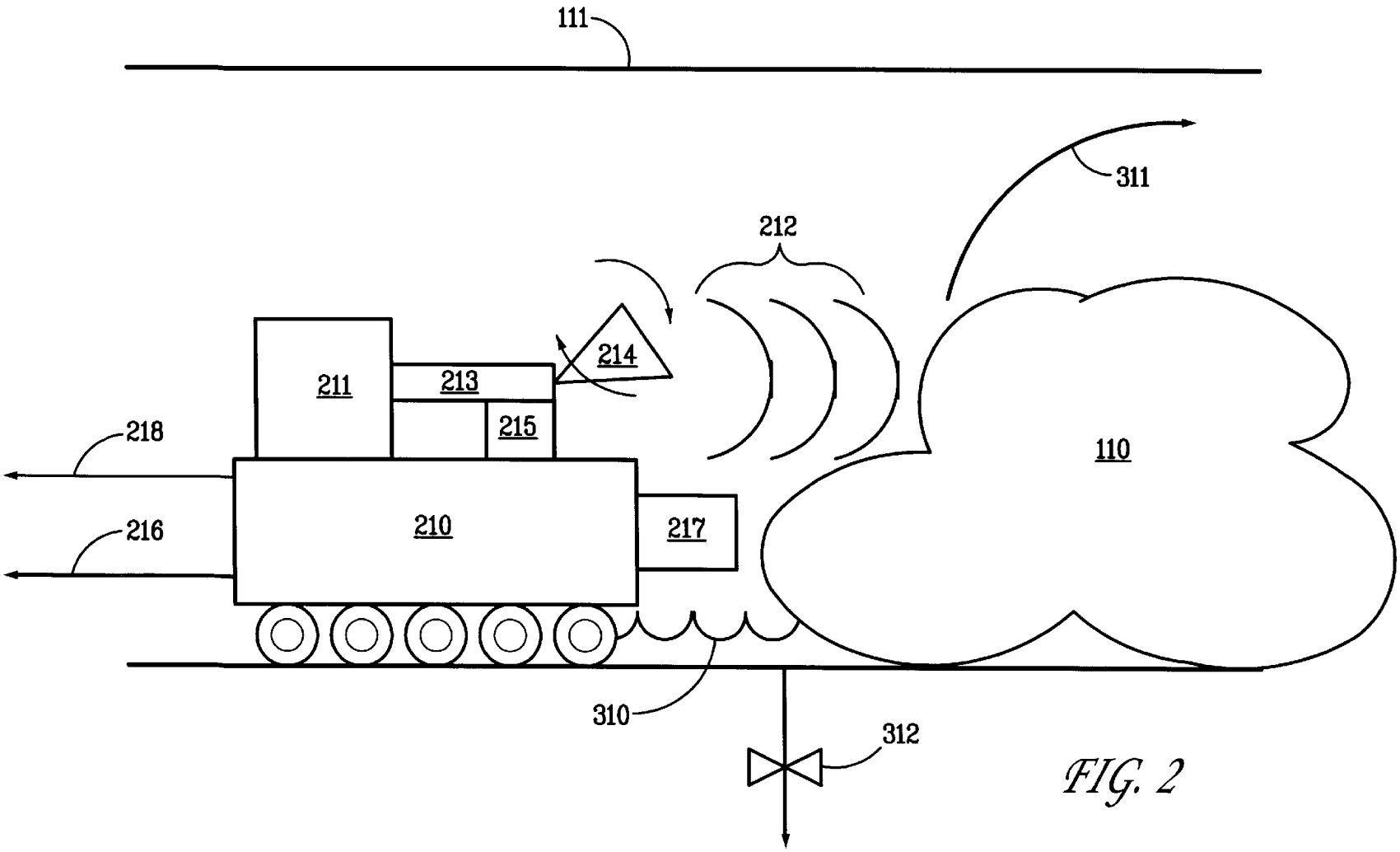
FIG. 2 is a simplified schematic diagram showing major processing steps in one embodiment of the invention, namely dissociating a hydrate blockage in a pipeline.

Now referring to FIG. 2, a hydrate mass 110 partially or completely obstructs a pipeline 111. A track-mounted buggy 210 is introduced into the pipeline through a convenient access port (not shown). The buggy 210 supports a microwave generator 211. Microwave radiation 212 is transferred from the generator 211, through a waveguide 213, and directed onto the hydrate mass by way of a horn antenna 214. The antenna may be mounted at an acute angle relative to the axis parallel to the pipeline, and may be configured such that a motor drive 215 spins the antenna. In this way, the entire hydrate accumulation may be dissociated.

A power cable 216 transmit DC electrical signals to power the buggy 210, motor drive 215 and microwave generator 211, and a buggy-mounted, lighted video camera 217. The camera 217 allows operators to view the vicinity of the pipeline ahead of the buggy; video camera signals are transmitted to operators by way of a coaxial cable 218. The power cable 216 and coaxial cable 218 exit the pipeline through a pressure-tight access port (not shown).

Liquid water 310 and natural gas 311 produced during the recovery process are allowed to accumulate within the pipeline. Alternatively, the said liquid water 310 may be withdrawn from a blow-down valve 312.

THIRD EMBODIMENT

Recovery of gas from a hydrate-bearing rock formation

This embodiment is distinct from the first and second embodiments described above in that hydrates occupy the pore spaces of a rock formation in a petroleum reservoir. The rock formation of interest is near a wellbore.

| Typical Process Conditions | Temperature, ° C. Useful | Pre-ferred | More Pre-ferred | Pressure, kPa Useful | Pre-ferred | More Preferred |
|---|---|---|---|---|---|---|
| Natural Gas Recovery from Hydrates | −40 to +40° C. | −30 to +25° C. | −20 to +10° C. | 100 to 70,000 | 100 to 30,000 | 102.5 to 200 |

Gas recovery pressure and temperature are set by that of the petroleum reservoir and the wellbore.

Figure 3:
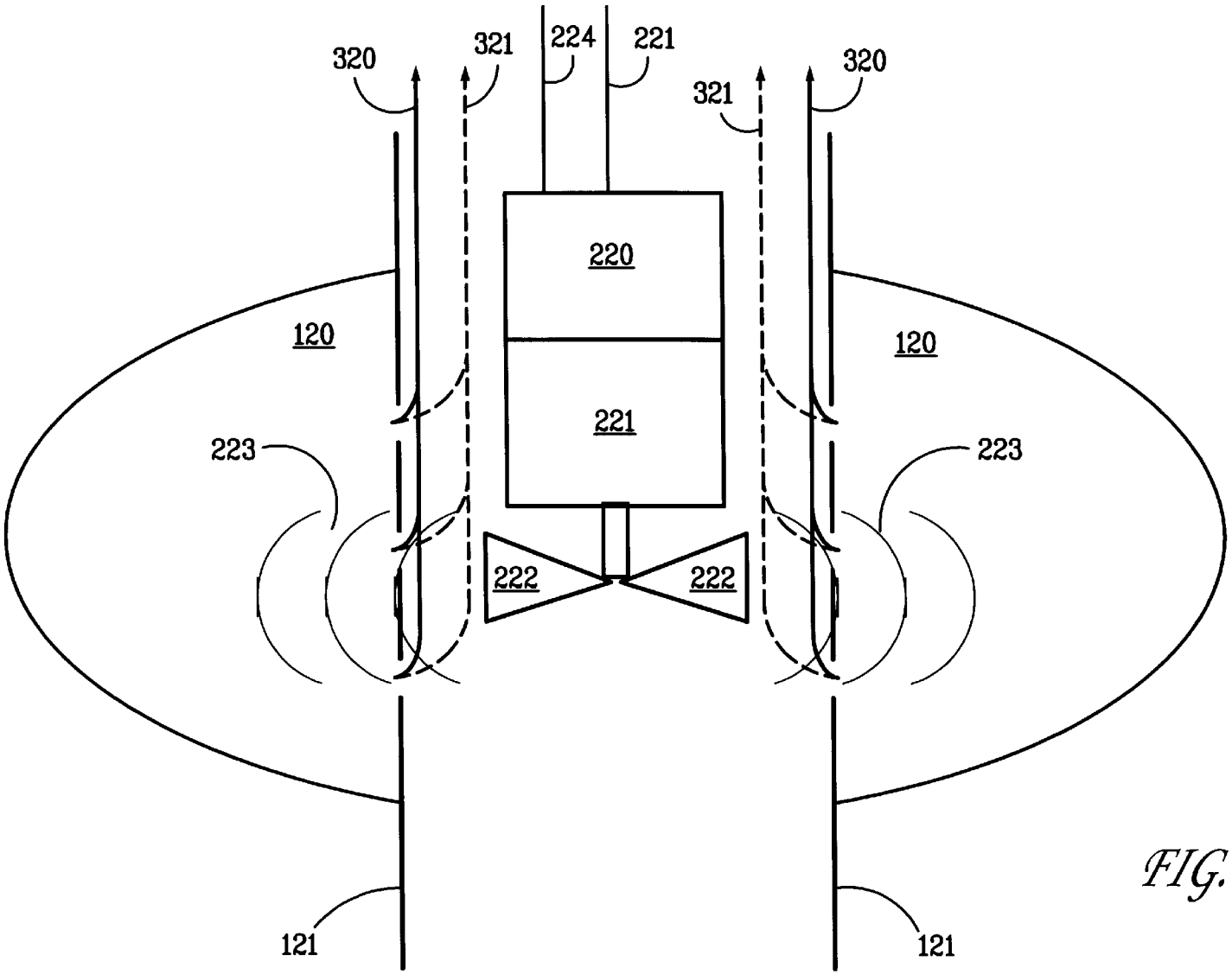
FIG. 3 is a simplified schematic diagram showing major processing steps in one embodiment of the invention, namely in-situ dissociation of hydrates within a petroleum-bearing rock formation in the vicinity of a production well.

Now referring to FIG. 3, a rock formation containing hydrates 120 surrounds a perforated wellbore casing 121. A downhole tool 220 is connected to the drilling platform (not shown) by a wireline 225, and is positioned in the hydrate-containing formation 120. The downhole tool 220 supports a microwave generator 221, and one or more horn-type microwave antennas 222 designed to direct microwave radiation 223 through the wellbore casing 121, and into the rock formation 120. The microwave generator 221 is powered by way of a DC power supply cable 224. Gas 320, and water 321, are produced like any petroleum reservoir fluid.

EXAMPLE

Gas hydrates can be intentionally produced to store and transport gases. These other gases can be commercial products or pollutants or other gas types that form in natural or industrial processes. Solid hydrate particles can be used in power stations and in processes intended for reduction of pollution. Solid hydrate particles can be used where gas has to be added in large amounts, in aquatic environments, both natural and artificial.

Gas hydrates can form spontaneously and unintentionally in gas pipelines under the correct temperature, pressure, gas composition and water content. In this situation, hydrates are undesirable as they plug pipelines and reduce their operating efficiency. Likewise gas hydrates can form spontaneously in naturally occurring petroleum reservoirs. According to a recent estimate, 700,000 Trillion Cubic Feet of natural gas, or 53% of the earth's organic carbon reserves, are in naturally-occurring hydrate deposits (Ref: Kvenvolden, K. A. in "International Conference on Natural Gas Hydrates", E. D. Sloan et al., eds, New York Academy of Science, N.Y.C., 1994, p. 232).

Artificially-produced gas hydrates can be transported from offshore storage vessels by boat, tankers, barges or floating containers towed by tugboats to the shore. In the most preferred arrangement, hydrate particles are transferred from the storage vessels offshore through a pipeline or a mechanical conveyor to a tanker by a combination of screw conveyors and gravity feed. The tanker can, but does not need to, be able to store the particles under gauge pressure. The particles can be transported to the shore as solid cargo or in water or in a hydrocarbon based liquid. Gas that escapes from the particles during transportation can be pressurized and/or used to operate the tanker and the cooling equipment, other means to dispose the extra gas.

Hydrate particles can also be stored in underground storage rooms, such as large caverns blown in rock formations. This can be accomplished by cooling/refrigerating the underground storage cavern prior to the supply of gas hydrates, so that any naturally occurring water freezes and forms an isolating ice shell on the "vessel" walls. In this way, gas escape from the storage cavern can be prevented. Like ordinary isolated vessels, the gas hydrate produced in accordance with the invention can be stored near atmospheric pressure, as described in further detail below.

Artificially-produced gas hydrates are after the transportation pumped or transferred by other ways, such as screw conveyor from the tanker to one or several storage tanks onshore. The gas may also be recovered by in-situ onboard regassifications. The melting can be accomplished using different types of heating, e.g. with emission from a gas operated power station, or the hot water exit from the turbine engine. Cold melting water can be used as coolant for any power station, thus improve the ordinary cooling towers efficiency. When the tanker is emptied, melting water and process water can be loaded. The water can have its origin from a former cargo. The melting water will be ballast for the tanker from the shore to an offshore platform. When the tanker loads the particles at the platform, the melting water is unloaded. The vessels at the platform accept the melting water for use in the hydrate production. If desired, air may be removed from the melting water and the process water and optionally pre-treated. The air removal can be effected onshore and/or offshore. In addition, the water can be used for injection to a reservoir.

In the cases of dissociating hydrate accumulations in pipelines or reservoir rock formations, the liquid water and gas produced during the dissociation reaction will flow as any other fluid. Thus, no special handling requirements are needed.

BIBLIOGRAPHY

1. Katz, D. et al., "Handbook of Natural Gas", pp. 189–221, McGraw-Hill, N.Y., 1959.

2. Sloan, E. D. Jr., "Clathrate Hydrates of Natural Gases", Marcel Dekker, 1991.

3. "International Conferences on Natural Gas Hydrates", Editors: E. D. Sloan, Jr., J. Happel, M. A. Hnatow, Sloan, E. D. Jr., J. Happel, M. A. Hnatow (eds). 1994, pp. 225–231-"Overview: Gas Hydrates Geology and Geography", R. D. Malone; pp. 232–246-"Natural Gas Hydrate Occurrence and Issues", K. A. Kvenvolden.

4. Miller, B., and E. R. Strong, American Gas Association Mon, v. 28 (2), p. 63–1946.

5. Gudmundsson, J. S., et al., "Transport of Natural Gas as Frozen Hydrate", ISOPE Conf. Proc., V1, The Hague, NL, June, 1995.

6. Gudmundsson, J. S., et al., "Storing Natural Gas as Frozen Hydrate", SPE Production & Facilities, February 1994

7. Smirnov, L. F., "New Technologies Using Gas Hydrates", Teor. Osn. Khim.

Tekhnol., V23(6), pp. 808–22 (1989),

8. Long, J. "Gas Hydrate Formation Mechanism and Kinetic Inhibition", PhD Dissertation, 1994, Colorado School of Mines, Golden, Colo.

9. Sloan, E. D. Jr., "The State-of-the-Art of Hydrates as Related to the Natural Gas Industry", Topical Report GRI 91/0302, June, 1992.

10. Englezos, P., "Clathrate Hydrates", Ind. Eng. Chem. Res., V32, pp. 1251–1274, 1993

11. Kim, H. C. et al., "Kinetics of Methane Hydrate Decomposition," Chemical Engineering Science, Vol. 42, No. 7, pp. 1645–1653 (1987).

12. Burshears, M. et al., "A Multi-Phase, Multi-Dimensional, Variable Composition Simulation of Gas Production from a Conventional Gas Reservoir in Contact with Hydrates,"., Unconventional Gas Technology Symposium of the Society of Petroleum Engineers, pp. 449–453 (1986), 13. Selim, M. S. et al., "Hydrate Dissociation in Sediment", 62nd Annual Technical Conference and Exhibition of the Society of Petroleum Engineers, pp. 243–258 (1987).

14. McGuire, P. L., "Methane Hydrate Gas Production: An Assessment of Conventional Production Technology as Applied to Hydrate Gas Recovery", Los Alamos National Laboratory, pp. 1–17 (1981).

15. Guo, T. M. et al., "Gas Hydrates Decomposition and Its Modeling", 1992 International Gas Research Conference, pp. 243–252 (1992).

16. Parsons, R. W., "Microwave Attenuation-A New Tool for Monitoring Saturations in Laboratory Flooding Experiments", S.P.E.J., pp. 302–310, August 1975.

17. Brost, D. F. et al., "Determination of Oil Saturation Distributions in Field Cores By Microwave Spectroscopy", SPE reprint #10110, 1981.

18. Parmerswar, R. et al., "Design and Operation of the Three-Phase Relative Permeability Apparatus (X-ray/Microwave System)", NIPER-119, 1992.

19. Article in Oil & Gas Journal, v. 94, (49), p. 66–67, Dec. 2, 1996.

20. Schwann, H. P., Ann. New York Academy of Science, v. 125, p. 344, October 1965.

21. Osepchuk, J. "Microwave Technology", in V. 16 of Kirk-Othmer's Encyclopedia of Chemical Processing, 4th Ed., Marcel Dekker, pp. 672–700, 1995.

22. Ref: Kvenvolden, K. A. in "International Conference on Natural Gas Hydrates", E. D. Sloan et al., eds (New York Academy of Science, N.Y.C., 1994) p. 232.

What is claimed is:

1. A method for recovering gas by dissociating gas hydrates comprising the steps of:

(a) providing the gas hydrate within an occupying zone;

(b) positioning a source of electromagnetic radiation within the occupying zone; and (c) recovering gas from said gas hydrates by applying electromagnetic radiation from the electromagnetic radiation source of step (b) to the gas hydrates at a frequency within the range of from direct current to visible light at energy density sufficient to dissociate the gas hydrates to evolve its constituent gas.

2. The method of claim 1 wherein said electromagnetic radiation is microwave radiation.

3. The process of claim 1 wherein said recovering step (c) is conducted in the absence of added hydrocarbon.

4. The method of claim 1 wherein the electromagnetic radiation source of step (b) is stationary.

5. The method of claim 1 wherein the electromagnetic radiation source of step (b) is movable.

6. The method of claim 1 wherein the occupying zone is a storage vessel.

7. The method of claim 1 wherein the occupying zone is a pipeline.

8. The method of claim 1 wherein the occupying zone is a hydrate-bearing rock formation.

9. The method of claim 1 wherein liquid water is produced during the recovering step (c).

10. The method of claim 9 wherein the liquid water produced is disposed, collected, and/or held in contact with the gas hydrates.

11. The method of claim 10 further comprising directing the electromagnetic radiation to a surface of the gas hydrates with a hollow waveguide.

12. The method of claim 11 further comprising controlling the directing step to irradiate the gas hydrates in preference to the liquid water in contact with the gas hydrates.

13. The method of claim 9 further comprising directing the electromagnetic radiation source onto a surface of the gas hydrates by sensing a difference in optical reflectance between the gas hydrates and the liquid water.

* * * * *